US007748318B2

(12) United States Patent
Kruempelmann et al.

(10) Patent No.: US 7,748,318 B2
(45) Date of Patent: Jul. 6, 2010

(54) POLYCHROME ROTARY PRESS

(75) Inventors: Martin Kruempelmann, Lengerich (DE); Manfred Loddenkoetter, Ibbenbueren (DE)

(73) Assignee: Windmoeller & Hoelscher KG, Lengerich (DE)

( * ) Notice: Subject to any disclaimer, the term of this patent is extended or adjusted under 35 U.S.C. 154(b) by 185 days.

(21) Appl. No.: 10/555,956

(22) PCT Filed: May 6, 2004

(86) PCT No.: PCT/EP2004/005127

§ 371 (c)(1),
(2), (4) Date: Nov. 7, 2005

(87) PCT Pub. No.: WO2004/098890

PCT Pub. Date: Nov. 18, 2004

(65) Prior Publication Data

US 2007/0101882 A1 May 10, 2007

(30) Foreign Application Priority Data

May 7, 2003 (DE) ..... 103 20 205

(51) Int. Cl.
*B41F 13/24* (2006.01)

(52) U.S. Cl. ..... 101/248; 101/486; 101/DIG. 36

(58) Field of Classification Search ..... 101/248, 101/286, 181, 216, 484, 485, 486, DIG. 36
See application file for complete search history.

(56) References Cited

U.S. PATENT DOCUMENTS

| | | | | |
|---|---|---|---|---|
| 3,963,902 | A | 6/1976 | Dowd | |
| 4,042,916 | A * | 8/1977 | Chang | 365/13 |
| 4,176,404 | A * | 11/1979 | Dimyan et al. | 365/12 |
| 4,484,522 | A | 11/1984 | Simeth | |
| 5,551,339 | A * | 9/1996 | Schadlich et al. | 101/216 |
| 5,674,169 | A * | 10/1997 | Yang | 483/32 |
| 5,778,779 | A | 7/1998 | Jones et al. | |
| 6,293,194 | B1 | 9/2001 | Vrotacoe | |
| 6,314,883 | B1 * | 11/2001 | Wech | 101/248 |
| 6,634,297 | B2 | 10/2003 | Poetter et al. | |

FOREIGN PATENT DOCUMENTS

| | | | |
|---|---|---|---|
| CA | 12 23 150 | | 6/1987 |
| CH | 667 425 | A5 | 10/1988 |
| DE | 31 36 703 | C1 | 11/1982 |
| DE | 42 39 089 | A1 | 11/1993 |
| DE | 44 01 269 | A1 | 7/1995 |
| DE | 297 20 928 | U1 | 2/1998 |
| DE | 198 32 892 | A1 | 1/2000 |
| DE | 19832892 | A1 * | 1/2000 |

(Continued)

*Primary Examiner*—Ren Yan
(74) *Attorney, Agent, or Firm*—Jacobson Holman PLLC

(57) ABSTRACT

A multi-color rotary printing machine has one printing plate support assigned to the colors that are transferred onto the print substrate. This printing plate support supports a printing plate and is attached to a mandrel or a cylinder of a rotary printing machine in order to transfer the print image onto the print substrate. The rotary printing machine has register devices that determine the position of the printing plates with respect to one another and that have sensors to determine the positions of the printing plate support in the printing machine.

17 Claims, 2 Drawing Sheets

FOREIGN PATENT DOCUMENTS

| | | | | |
|---|---|---|---|---|
| DE | 198 54 343 | A1 | | 5/2000 |
| DE | 101 45 957 | A1 | | 10/2002 |
| DE | 102 54 836 | A1 | | 6/2004 |
| EP | 0 806 294 | B1 | | 11/1997 |
| EP | 0 835 753 | A1 | | 4/1998 |
| EP | 0835753 | A1 | * | 4/1998 |
| EP | 1 205 300 | A1 | | 5/2002 |
| EP | 1205300 | A1 | * | 5/2002 |
| GB | 2 146 291 | A | | 4/1985 |
| WO | WO 2004 048092 | A2 | | 6/2004 |

* cited by examiner

POLYCHROME ROTARY PRESS

CROSS-REFERENCE TO RELATED APPLICATION

This is a nationalization of PCT/EP04/005127 filed May 6, 2004 and published in German.

BACKGROUND OF THE INVENTION

1. Field of Invention

The present invention relates to a multi-color rotary printing machine in which one printing plate support each is assigned to the colors to be transferred onto the print substrate, whereby said printing plate support supports a printing plate and can be attached to a mandrel or a cylinder of a rotary printing machine in order to transfer the print image onto the print substrate, whereby the rotary printing machine has register devices that determine the position of the printing plates with respect to one another.

2. Description of the Prior Art

Machines of such type are designed, for example, as flexographic printing machines and gravure printing machines. The term "printing plate support" refers to all possible cylinders, sleeves, or even flexible mats that support a printing plate. Thus, for example, a cylinder that supports a printing plate and is supported using bearing pins and/or bearing points is used conventionally in gravure printing. However, in recent times the so-called sleeves that are drawn up over a cylinder are also used in gravure printing just as in case of flexographic printing. Many different colors are used particularly in package printing. As a result, the high demands made on register accuracy play an important role in this context. However, register accuracy also plays an important role in other areas and in the application of other print processes. The still unpublished patent application having the file number 102 54 836. 6-27 and that has also been submitted to the German Patent and Trademark Office addresses this issue of register processes in detail.

In the literature relevant to this subject, no mention is usually made of the manner in which the positions of the printing plate supports with respect to one another are determined before and at the time of the start of the print process. Said positions are determined, for example, in flexographic printing machines of prior art by an alignment of the printing plate—usually an alignment of a printing sleeve to a pin protruding in the radial direction over the peripheral surface of the print cylinder.

The printing sleeve has a recess into which the pin fits with relative accuracy. It is a laborious and time-consuming process for the machine operator to align the printing sleeve correctly. This process is often referred to as pre-register control.

In addition to that, the clearance between the pin and the recess results in inaccuracies during the register control.

This clearance strongly increases in direct proportion to the service life particularly of printing plate supports of flexographic printing that are manufactured from plastic and are often replaced. Register errors can often occur and/or multiply even during the ongoing operation if printing plates, while in operation, shift on the mandrels or the cylinders on which they are seated.

A more accurate pre-register control of the sleeve that could reduce the said disadvantages also forms the subject matter of U.S. Pat. No. 5,551,339. Said document illustrates a printing machine that is provided with sensor devices which observe the peripheral surface of the printing sleeves. Information carriers are located on the peripheral surface of the printing sleeves. The position of the information carriers is recorded after the sleeves are inserted into the machine and before the start of the actual printing operation. After the angle position of the sleeve on the mandrel on which it is located is determined, the torque-proof connection between the mandrel and the sleeve is broken, the sleeve is grasped by a frame-fixed gripping devices and prevented from bringing about a rotation of the mandrel. Subsequently, the sleeve being stationary, the mandrel is rotated in such a manner that a relative target position between the sleeve and the mandrel sets in. U.S. Pat. No. 6,314,883 also describes a process of pre-register control in which an information carrier attached to the sleeve and a sensor are specified for recording the position of said sleeve.

SUMMARY OF THE INVENTION

The objective of the present invention is to improve the accuracy and the quality of this register process.

Said objective is achieved by the characteristic features of the invention as described herein.

The measures according to the present invention can effectively prevent the information carriers, for example in case of optical sensors, from getting smudged and consequently resulting in register inaccuracies. The information carriers can get smudged and result in such register inaccuracies even in the case of magnetic or electromagnetic sensors. An additional advantage is that in case of all types of sensors, it is possible to prevent damages to the information carriers resulting from the print and the filling in the print image The following specifications are useful in promoting an understanding of the present invention.

The sensors of the register devices can comprise markings, data carriers or the like, referred to in the following as information carriers that are specially intended for this purpose. The simplest form of an information carrier is a simple line-shaped marking. However, these sensors can also scan characteristic surface features of conventional printing plate supports that are not loaded with information carriers—such as the raised edge of a printing plate used in flexographic printing.

The positions of the printing plates can be made accessible to the machine operator, for example, using a suitable interface such as a display, a monitor or a printer. The machine operator can then make corrections in the positions of the printing plates with respect to one another. For this purpose, he will, in the known fashion, manually adjust the drive connections between the drive and the print cylinders or the printing mandrels in case of the longitudinal register adjustment in a printing machine that is equipped with only one drive. In case of directly driven machines that have been disclosed in the patent application Ca 12 23 150, the machine operator can make such adjustments by a corresponding control of the drives driving the respective mandrels or cylinders.

It proves to be advantageous if a control unit carries out said control.

A printing plate support is known from the patent application DE 297 20 928 U1.

that supports a printing plate and that can be attached to the mandrel or the cylinder of a rotary printing machine in order to transfer the print image onto the print substrate and that contains at least one information carrier from which information can be removed using a read-out device.

In this connection, the printing plate support is a sleeve, the information carrier is a transponder chip and the information stored on the chip characterizes the print image and is related to the printing sleeve itself (print image, color, age etc.). Information of such type is also often imprinted on printing sleeves in the form of plain text or bar codes. Printing plate supports form a system together with a rotary printing machine according to the present invention if the information that can be read out automatically is suitable for determining the relative position of the printing plate support on the mandrel or the print cylinder of a rotary printing machine.

Preferred types of arrangement of the information carrier have been specified in the dependent claims. As mentioned earlier, information carriers can also be distinct as pronounced markings on the periphery of the printing plate support. Such markings can be present as notches or coloring in the material of the printing plate support and can be detected using optical sensors. However, this purpose can also be achieved by using a metal strip that is fixed in the material of the printing plate support and that can be detected using a suitable electromagnetic sensor. If such simple markings are designed as a line or a point, they can supply a small amount of information during a rotation of the printing plate support. However, this information is basically sufficient for determining the angle position of the printing plate support in the peripheral direction (longitudinal register) and the axial position of the printing plate support on the print cylinder and/or on the mandrel (transverse register). However, information carriers that are stretched over large areas of the peripheral surface in the peripheral direction are preferred. Such information carriers can be loaded with larger amounts of information and it is possible that the sensor can record the exact position of the printing plate over a large angular range of the rotation of the printing plate around the mass centroid axis of the mandrel or the print cylinder. This additional information can benefit the quality of the longitudinal register.

Optically recognizable markings can get smudged in the printing operation until it is no longer possible for the sensors to detect them. Therefore, information carriers such as magnetic tapes, transponder dipole chains, sequences of suitable metal structures etc. that can be read out magnetically or electromagnetically are preferred. For example, according to one embodiment of the present invention, the information carrier includes a sequence of magnetizable individual elements.

The register quality can be increased further if, in addition to the position of the printing plate support, the position of the print substrate is also recorded and used for register control. This is feasible using the processes that are known from prior art and in which the print substrate is provided with register markings whose position is recorded by sensors. For the purpose of studying this process, reference is made again to the still unpublished patent application having the file number 102 54 836.6-27 that has been submitted to the German Patent and Trademark Office.

If information is available both regarding the position of the printing plates as well as the position of the print substrate in the printing machine, it is also possible to take into account, during the register control, additional factors influencing the print quality that stem from a change in the condition of the print substrate (e.g. fan-out and web elongation).

Additional embodiments of the present invention are explained in the present description and in the claims.

Since printing machines per se are known, this description does not contain an illustration of an entire printing machine or of the installation position of a printing plate support according to this invention in a printing machine according to this invention.

BRIEF DESCRIPTION OF THE DRAWINGS

In this context, for the purpose of an example, reference has been made once again to the documents cited above and the patent application DE 101 45 957.2 A1. Printing machines known from prior art and register processes are illustrated in these documents. Only a sensor 3 must be inserted into such printing machines in such a manner that it can detect the position of the printing plate support 1 in the printing machine. The figures illustrate.

DESCRIPTION OF THE PREFERRED EMBODIMENTS

Further scope of applicability of the present invention will become apparent from the detailed description given hereinafter. However, it should be understood that the detailed description and specific examples, while indication preferred embodiments of invention, are given by way of illustration only, since various changes and modifications within the spirit and scope of the invention will become apparent to those skilled in the art from this detailed description.

Figure 1:
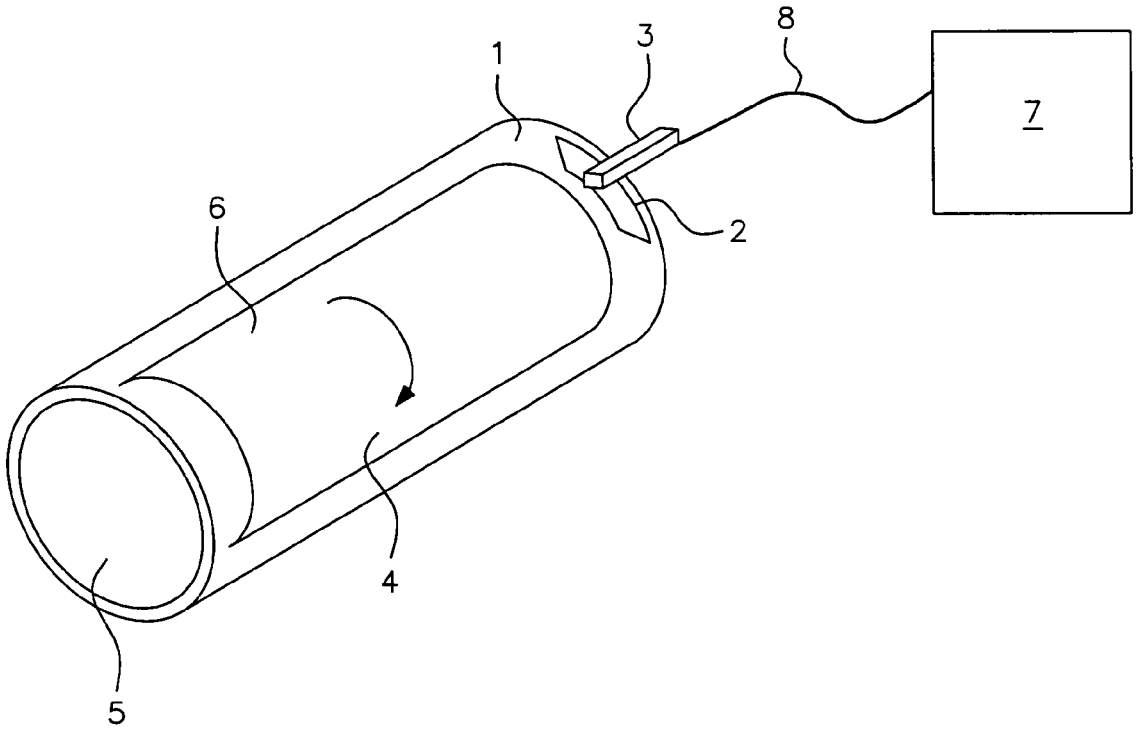
FIG. 1: a diagram of a printing plate support according to the present invention

FIG. 1 illustrates schematically the arrangement of an embodiment of a printing plate support 1 according to the present invention that has an information carrier 2. In this embodiment, the information carrier is an intentionally shaped magnetic tape 2 that is embedded into the printing plate support 1. However, linear magnetic tapes are usually preferred. The sensor 3 is attached at an appropriate place of the printing machine that is not illustrated here. The sensor 3 is suitable for reading out the magnetic tape 2. The sensor 3 transmits an analog signal over the signal line 8 to the control device 7 of the printing machine which subjects the signal to an analog/digital transducer and takes into account the information contained when generating register correction signals for the drives of the printing machine.

The greatest advantage of this embodiment is the simplification of the pre-register control that is carried out according to prior art as mentioned above with the help of a pin. However, the information that is read out from the sensor 3 can also be consulted during the ongoing print process in order to improve the register control. The figure also illustrates that the printing plate support 1 is a printing sleeve that is drawn up on the print cylinder 5 of the printing machine in the printing operation. Such arrangements are known in flexographic printing. However, they are also used in recent times in gravure printing.

The printing sleeve and/or the printing plate support supports the printing plate 6. In this embodiment, the information carrier is arranged between the edge of the printing plate 6 and a front edge of the sleeve 1.

The arrow 4 indicates the direction of rotation of the print cylinder 5.

Figure 2:
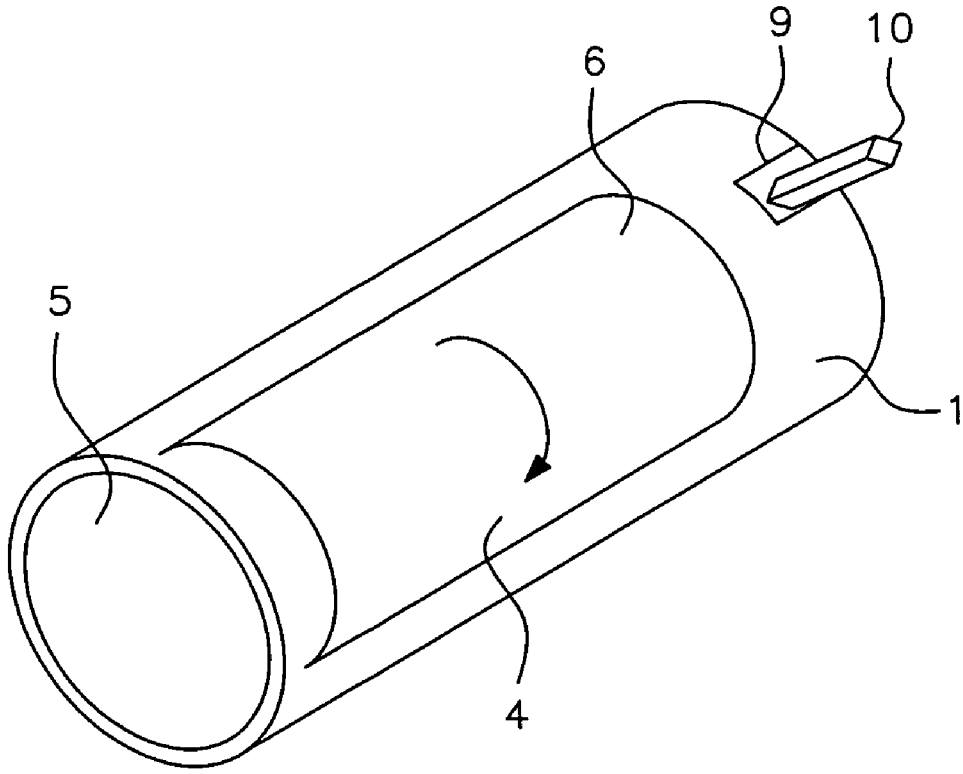
FIG. 2 PRIOR ART
FIG. 2: a diagram of a printing plate support according to prior art.

FIG. 2 illustrates a printing plate support 1 according to prior art that is provided with a recess 9. The printing plate support is designed as a sleeve that is drawn up on the print cylinder 5. When drawing up the printing, sleeve on the print cylinder, the machine operator must ensure that the recess 9 accommodates the register pin 10 of the cylinder 5 that protrudes over the peripheral surface of the print cylinder in the radial direction. Only then can a satisfactory pre-register control be ensured according to prior art.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Symbols | |
|---|---|
| 1 | Printing plate support |
| 2 | Sensor |
| 3 | Sensor |
| 4 | Arrow |
| 5 | Cylinder |
| 6 | Printing plate |
| 7 | Recess |
| 8 | Register pin |
| 9 | |
| 10 | |
| 11 | |
| 12 | |
| 13 | |
| 14 | |
| 15 | |
| 16 | |
| 17 | |
| 18 | |
| 19 | |
| 20 | |
| 21 | |
| 22 | |
| 23 | |
| 24 | |

What is claimed is:

1. A multi-color rotary printing machine, comprising:

one printing plate support each assigned to colors to be transferred onto a printing plate, said printing plate support supporting the printing plate and being attached to a mandrel or a cylinder of the rotary printing machine in order to transfer a print image onto a print substrate; and register devices that determine a peripheral position and an axial position of the printing plates with respect to one another, the register devices including sensors that determine the peripheral and the axial positions of the printing plate support in the printing machine and the register devices providing information regarding the peripheral and the axial positions of the printing plate support before, at the start of, or during a print process in conjunction with the sensors, based on which control signals are provided, the register devices including a control device with which control signals are generated based on the peripheral and the axial positions of the printing plate support determined by the sensors and with which drives of the mandrels or the print cylinders are controllable using said control signals such that at least one of the peripheral position and the axial position of the mandrels or the print cylinders in relation to one another is changed and a register accuracy of the print increases, each printing plate support including at least one information carrier that includes a sequence of magnetizable individual elements from which information is removed using the sensor, the information that is read out being automatically suitable for determining relative peripheral and axial positions of the printing plate support on the mandrel or on the print cylinder of the rotary printing machine, and the information carrier being arranged outside the mandrel and between the print image and an edge of the printing plate support that is turned toward a front end of the mandrel or of the print cylinder.

2. The multi-color rotary printing machine according to claim 1, wherein the information carrier has an oblong shape and a long side that is essentially aligned in a peripheral direction of the printing plate support.

3. The multi-color rotary printing machine according to claim 2, wherein the information carrier surrounds a periphery of the mandrel or of the cylinder of the printing machine.

4. The multi-color rotary printing machine according to claim 2, wherein the information stored on the information carrier is magnetically readable.

5. The multi-color rotary printing machine according to claim 2, wherein the information carrier includes a magnetic tape.

6. The multi-color rotary printing machine according to claim 2, wherein the information carrier shape is rectangular.

7. The multi-color rotary printing machine according to claim 1, wherein the information carrier surrounds a periphery of the mandrel or of the cylinder of the printing machine.

8. The multi-color rotary printing machine according to claim 7, wherein the information stored on the information carrier is magnetically readable.

9. The multi-color rotary printing machine according to claim 7, wherein the information carrier includes a magnetic tape.

10. The multi-color rotary printing machine according to claim 1, wherein the information stored on the information carrier is magnetically readable.

11. The multi-color rotary printing machine according to claim 10, wherein the information carrier includes a magnetic tape.

12. The multi-color rotary printing machine according to claim 1, wherein the information carrier includes a magnetic tape.

13. A process for setting up a multi-color rotary printing machine before and at the start of a print process, comprising:

assigning one printing plate support each to colors to be transferred onto a print substrate, said printing plate support supporting a printing plate;

attaching the printing plate supports to mandrels or cylinders of the rotary printing machine in order to transfer a print image onto the print substrate;

determining with register devices a peripheral position and an axial position of the printing plates with respect to one another, the register devices including sensors that determine the peripheral and the axial positions of the printing plate support in the printing machine and the register devices providing information based on the peripheral and the axial positions of the printing plate supports determined by the sensors, with control signals being derived based on the information and the register devices including a control device that generates control signals based on the peripheral and the axial positions of the printing plate support determined by the sensors;

using the control signals to control drives of the mandrels or of the print cylinders such that at least one of the peripheral position and the axial position of the mandrels or of the print cylinders in relation to one another is changed so as to increase a register accuracy of the print, the printing plate supports each having at least one information carrier that includes a sequence of magnetizable individual elements from which information is removed using the sensor; and reading the information automatically and using the information to determine a relative peripheral and a relative axial position of the printing plate support on the mandrel or on the print cylinder of the rotary printing machine, with printing plates being used such that the information carrier is arranged outside the printing plate and between the print image and an edge of the printing plate support that is turned toward a front end of the mandrel or of the print cylinder.

14. The process according to claim 13, wherein during the change of the relative phase position of the mandrels or the print cylinders, the printing plate supports rest in relation to the mandrels or print cylinders assigned to the printing plate supports.

15. The process according to claim 14, wherein the multi-color rotary printing machine includes the printing plate support each assigned to the colors to be transferred onto the printing plate, said printing plate support supporting the printing plate and said printing plate support being attached to the mandrel or the cylinder of the rotary printing machine in order to transfer the print image onto the print substrate, the rotary printing machine having the register devices that determine the peripheral and the axial positions of the printing plates with respect to one another and the register devices having the sensors that determine the peripheral and the axial positions of the printing plate support in the printing machine and the register devices providing the information regarding the peripheral and the axial positions of the printing plate support before, at the start of, or during the print process in conjunction with the sensors, based on which the control signals are provided, the register devices having the control device that generates the control signals based on the peripheral and the axial positions of the printing plate support determined by the sensors and that controls the drives of the mandrels or of the print cylinders using said control signals such that at least one of the peripheral position and the axial position of the mandrels or of the print cylinders in relation to one another is changed and the register accuracy of the print increases, with each of the printing plate supports containing the at least one information carrier from which the information is removed using the sensor, and with the information that is read out automatically being suitable for determining the relative peripheral and axial position of the printing plate support on the mandrel or on the print cylinder of the rotary printing machine, and with the information carrier being arranged outside the printing mandrel and between the print image and the edge of the printing plate support that is turned toward the front end of the mandrel or of the print cylinder.

16. A multi-color rotary printing machine, comprising:

a printing plate support that supports a printing plate and that is assigned to colors to be transferred onto the printing plate, the printing plate support being attached to a mandrel or a cylinder of the machine in order to transfer a print image onto a print substrate during a printing process; and register devices that determine a peripheral position and an axial position of the printing plates with respect to one another, the register devices including sensors that determine the peripheral and the axial positions of the printing plate support in the machine and the register devices providing information regarding the peripheral and the axial positions of the printing plate support before, at the start of, or during the printing process in conjunction with the sensors based on which control signals are provided, the register devices including a control device that generates control signals based on the peripheral and the axial positions of the printing plate support determined by the sensors and with which drives of the mandrels or the print cylinders are controllable using said control signals such that at least one of the peripheral position and the axial position of the mandrels or the print cylinders in relation to one another is changed and a register accuracy of the print increases, each printing plate support including at least one information carrier from which information is removed using the sensor, the information carrier having a sequence of magnetizable individual elements, with the information that is removed being magnetically readable and being automatically adapted for determining a relative peripheral position and a relative axial position of the printing plate support on the mandrel or on the print cylinder, and the information carrier being arranged outside the printing mandrel and between the print image and an edge of the printing plate support that is turned toward a front end of the mandrel or of the print cylinder.

17. The multi-color rotary printing machine according to claim 16, wherein the information carrier has a rectangular shape with a long side that is substantially aligned in a peripheral direction of the printing plate support.

* * * * *